US006314694B1

(12) United States Patent
Cooper et al.

(10) Patent No.: US 6,314,694 B1
(45) Date of Patent: Nov. 13, 2001

(54) ONE-SIDED INSULATED FORMWORK

(75) Inventors: Bruce Reginald Cooper; G. Richie Scott; Robert Elias Sculthorpe; Gary Woolgar, all of Ontario (CA)

(73) Assignee: ARXX Building Products Inc., Ontario (CA)

( * ) Notice: Subject to any disclaimer, the term of this patent is extended or adjusted under 35 U.S.C. 154(b) by 0 days.

(21) Appl. No.: 09/218,616

(22) Filed: Dec. 22, 1998

Related U.S. Application Data

(63) Continuation-in-part of application No. 09/213,178, filed on Dec. 17, 1998, now abandoned.

(51) Int. Cl.[7] ..... E04C 1/00

(52) U.S. Cl. ..... 52/309.12; 52/426; 52/432; 52/442; 52/565; 249/190; 249/40

(58) Field of Search ..... 52/309.12, 426, 52/431, 432, 442, 565, 563, 745.09; 249/190, 40

(56) References Cited

U.S. PATENT DOCUMENTS

| | | | | |
|---|---|---|---|---|
| 2,506,485 | * | 5/1950 | Boudousquie, Sr. | 249/190 |
| 3,383,817 | * | 5/1968 | Gregori | 52/309.12 |
| 4,116,415 | | 9/1978 | Ward . | |
| 4,223,501 | * | 9/1980 | DeLozier | 52/309.12 |
| 4,229,920 | | 10/1980 | Lount . | |
| 4,426,061 | * | 1/1984 | Taggart | 249/45 |
| 4,805,366 | | 2/1989 | Long . | |
| 4,860,515 | * | 8/1989 | Browning, Jr. | 52/426 |
| 4,936,540 | * | 6/1990 | Boeshart | 249/40 |
| 4,949,515 | | 8/1990 | Krecke . | |
| 5,065,561 | | 11/1991 | Mason . | |
| 5,323,578 | * | 6/1994 | Chagnon et al. | 249/40 |
| 5,390,459 | | 2/1995 | Mensen . | |
| 5,657,600 | * | 8/1997 | Mensen | 52/309.12 |
| 5,692,356 | | 12/1997 | Baxter . | |
| 5,701,710 | | 12/1997 | Tremelling . | |
| 5,809,727 | | 9/1998 | Mensen . | |
| 5,845,445 | | 12/1998 | Blackbeard . | |
| 5,861,105 | * | 1/1999 | Martineau . | |
| 6,079,176 | * | 6/2000 | Westra et al. | 52/404.2 |

FOREIGN PATENT DOCUMENTS 2209251 1/1999 (CA) .

* cited by examiner

*Primary Examiner*—Carl D. Friedman
*Assistant Examiner*—Dennis L. Dorsey
(74) *Attorney, Agent, or Firm*—Morgan, Lewis & Bockius, LLP

(57) ABSTRACT

One-sided, insulated formwork used in the construction of walls from pourable building material, such as concrete, including an insulating panel connectable to a removable panel by a connecting structure, which may include a permanent reinforcement embedded in the insulating panel. The connecting structure may have a tie removably attachable to the reinforcement, or the reinforcement and tie may constitute a monolithic structure. The tie may be asymmetric in shape to facilitate distribution of loads across the insulating panel, detachment of the removable panel, and enhance the structural integrity of the finished wall.

46 Claims, 13 Drawing Sheets

ONE-SIDED INSULATED FORMWORK

This application is a continuation-in-part of U.S. application Ser. No. 09/213,178, filed Dec. 17, 1998 (abandoned).

BACKGROUND OF INVENTION

1. Field of the Invention

The invention relates generally to building systems, and more particularly, to a method and apparatus for the construction of insulated walls from pourable building material, such as concrete, using a one-sided insulated formwork.

2. Discussion of the Related Art

Conventional formwork used in the construction of walls from pourable building material (e.g., pourable concrete) consist of two opposed wall panels (typically, plywood) connected by a rod, trusswork or other variety of connecting structure. The pourable building material is poured into the space (or cavity) formed between the opposed wall panels. As the building material is poured and subsequently cures, the panels are maintained in a fixed spaced relation by the connecting structure.

In recent years, it has been found desirable to use an insulating material for formwork wall panels for providing thermal and acoustic insulation to the finished wall. In the case of formwork used in the construction of concrete walls, the wall forms using an insulating material are commonly known as Insulated Concrete Formwork (ICF). The ICF is constructed into walls by stacking individual ICF components (sometimes referred to as blocks) to build an insulated wall form, which remains as a permanent part of the finished wall. After the building material has cured, the insulated wall panels are not removed from the cured wall surface as is the case with conventional plywood forms. Typically, the ICF component includes two insulating wall panels made of a foamed polymeric material such as plastic.

In certain applications, it is desirable to remove one of the walls while leaving the other wall in place after the building material has cured. For example, a builder may wish to have an exposed outer surface of concrete, or building codes may require that insulating material not be exposed to external elements as this material may have an unacceptable rate of degradation over time. In one known approach, builders will simply tear off the soft insulating material after the building material has cured. This technique is disadvantageous as it wastes material and adds to the cost associated with the cleanup and disposal of the non-reusable material. Another similar approach is found in U.S. Pat. No. 5,065,561 to Mason. Mason discloses removing one or both panels of a formwork (each panel being either foamed plastic panel or a plywood panel) via a frangible connection. Mason's formwork consists of slotted panels slid onto shanks integrally formed at each end of a connecting structure in the form of a bridge. After the concrete has cured, one or both of the panels are removed by breaking the bridge along a score line. This technique for removing panels is also disadvantageous. The web must be broken to disconnect the panel, which can be labor intensive and results in wasted material. Mason does not teach how to remove panels for formwork having a portion of the connecting structure molded into the insulating panels, such as the formwork described in U.S. Pat. Nos. 5,390,459, 5,567,600, and 5,809,727 to Mensen, the disclosures of which are incorporated by reference herein in their entirety.

European Publication 0591080-A1 of Gantan Beauty Industry Co. (Gantan) teaches a method for constructing walls using a formwork with a heat insulating member, surface side form, and back side form interconnected using a threaded socket assembly. In contrast to Mason, Gantan removes the back side form by disengaging the socket assembly (the back side form is therefore removable). However, Gantan suffers from numerous drawbacks, including the requirement that a surface pressure means and surface side form must be applied to the exterior surface of the insulating panel to provide the necessary strength for reacting pressure forces exerted by the curing concrete.

U.S. Pat. No. 4,426,061 to Taggart discloses a formwork for forming insulated walls consisting of an exterior form panel connected to an insulation panel using a T-shaped screw, brackets and spacer element positioned between the two panels. In similar fashion to that of Gantan, Taggart teaches a method for removing the form panel and suffers from the drawback of requiring externally applied end caps, retainer pieces and cross beams to provide the necessary strength for reacting pressure forces exerted on the insulating panel by the building material. The formwork systems in both Gantan and Taggart are additionally undesirable because the formwork support must be constructed on-site. Construction time and labor costs are increased, as are the number of components and complexity of the formwork due to the complicated, multi-part mechanical structure required by these types of systems.

Supporting structures are needed in ICFs to reinforce the insulating panels which have a low stress tolerance relative to conventional non-insulating material (e.g., plywood) used in conventional formwork panels. Accordingly, when insulating material is used, ICFs will typically require either an externally applied surface side form (as taught in Gantan), an end cap, retainer piece and cross beam (as taught in Taggart), a tie and fastening ends with sliding engagement with the panel (as taught in Mason), or a panel with molded-in supporting structure (as taught in Mensen). In each of these prior formworks, the additional reinforcing structure is necessary for distributing the load across a surface area of the insulating panel to reduce stress concentrations. None of the prior systems having a removable panel provide the advantages inherent in using an internal reinforcement for the insulating panel, such as taught in aforementioned patents to Mensen.

It is sometimes desirable to use an ICF which has two, reinforced insulating panels connected using a tie releasably engageable with each panel along its respective inner bearing surfaces (i.e., the surface of the panel which comes into contact with the poured concrete). These types of ICF systems are commercially available and are disclosed for example, in U.S. Pat. No. 4,229,920 to Lount and U.S. Pat. No. 5,701,710 to Tremelling. Tremelling and Lount each describe an ICF that provides a pre-reinforced insulating panel and a means for selectively choosing the wall thickness on site. These types of ICF also tend to reduce shipping costs because the panels and ties can be shipped separately and stored in a reduced volume, but typically are more costly overall due to increased on-site labor required to construct the forms. In addition, the structural integrity of each form is dependent upon the skills of the on-site laborer, unlike the ICFs completely assembled by the manufacturer, such as the ICF's taught in the aforementioned Mensen patents. None of the known ICF systems having a removable tie employ an ICF that includes a removable panel for use as a one-sided form.

As a result of the foregoing drawbacks and limitations in existing formwork systems, there exists a need for insulated formwork with a conveniently removable panel and reinforced insulating panel that does not require the on-site construction of externally applied supporting structure to reinforce the insulating panel. In particular, the existing formwork systems do not address the need for reducing the labor and material costs associated with detachment of the removable panel while avoiding the drawbacks of constructing complicated and labor intensive structural supports for the insulating panel on site. For example, it would be desirable to have a connecting structure for a one-sided insulated form that provides structural support to the insulating panel without the need for cross-beams, end caps or surface side forms, that also avoids having to break the form to remove a panel or requires complex connecting structure to facilitate detachment of the removable panel. There is also a need for a one-sided ICF system employing a removable tie and/or panel connecting structure where the provision of a variable wall thickness at the job site is also desirable.

SUMMARY OF THE INVENTION

The invention satisfies these needs while avoiding the problems and disadvantages of the prior art by providing a one-sided insulated wall form for use with a removable panel defining with the insulated wall form a space for receiving pourable building material, such as concrete. The one-sided form is constructed from a permanent panel made of an insulating material configured to remain a permanent part of a wall constructed with the form. A connecting structure, also configured to remain a permanent part of a wall constructed with the formwork, includes a first portion connectable to the permanent panel that provides sufficient support for the permanent panel during the wall building process. The connecting structure has a second portion releasably engageable with the removable panel, e.g. by a waler formed as a channel section connected between the removable panel and the second portion of the connecting structure by removable fasteners, such as self-tapping screws. The waler may be provided inside the form and configured to remain a part of the finished wall or, if reuse of the coupling is desired, can be provided external to the form. In the latter case, the portion of the bridging member that detachably connects the removable panel may need to be structurally reinforced.

Two of the one-sided forms could also be connected back-to-back to form a two-sided insulated formwork. Each of the opposed one-sided forms are connected to each other at the end portion of the tie normally associated with the removable panel connecting end.

The insulating material used for the permanent panel preferably is expanded polystyrene "EPS" or other material known in the art. The removable panel may be made from a non-insulating material. Preferably, the non-insulating material is plywood, or another structurally sound material different from the insulating material used for the permanent panel. The connecting structure may include a reinforcement member embedded in the permanent panel, e.g., by molding or slidably receiving a shank formed in the reinforcement member into a corresponding slot formed in the permanent panel (such as taught in the aforementioned Mason patent), and a tie integrally formed with the reinforcement member. In this case, the reinforcement member provides sufficient support for the permanent panel during the wall building process while the tie connects the permanent panel to the removable panel at a distance defining the space for pouring the building material. The connecting structure may also include a separate tie member detachably securable to the reinforcement member, preferably, at an inner bearing surface of the insulating panel. The detachably securable tie member may be particularly desirable when, for example, on-site wall thickness adjustment is needed. On the other hand, the connecting structure may be a unitary or monolithic member, such as the bridging member taught in the aforementioned Mensen patents.

In a further aspect of the invention, there is provided a one-sided insulated wall form including a permanent insulating panel including a reinforcement member providing sufficient support for the permanent panel during the wall building process. The insulating panel and reinforcement member are configured to remain a permanent part of a wall constructed with the form. The outer surface of the reinforcement member may be used as a furring strip to attach finishing material, as is known in the art. A tie member has a first end releasably engageable with the permanent panel and a second end having a panel connecting portion being couplable and de-couplable to the removable panel. The tie member may be releasably engageable with the reinforcement member at an inner bearing surface of the insulating panel. The panel connecting portion of the tie member may include a coupling for releasably securing the removable panel to the tie. The coupling may be a waler slidably received on the panel connecting portion and fastened to the removable panel using conventional removable fasteners.

In still another aspect of the invention, there is provided an asymmetric tie member particularly useful for connecting first and second panels of an insulated formwork made from dissimilar materials. The tie member has a first portion connectable to the first panel, and a second portion connectable to a second panel. The second portion of the tie member has a height substantially less than the height of the first portion. The first portion of the asymmetric tie member may be releasably engageable with the first panel, and the second portion may be releasably connectable with the second panel. Preferably, the tie member tapers in its mid-section from the first portion to the second portion. The asymmetric configuration reduces the amount of space occupied by the connecting structure spanning the space provided for pouring the building material. Additionally, the asymmetric tie member provides the necessary load distribution for the weaker panel, e.g., an insulating panel, to reduce stress concentrations and a smaller connecting portion for the stronger panel, e.g., a removable panel, which can sustain higher stress concentrations. When the stronger panel is a removable one, the asymmetric tie member provides a detachable connection facilitating removal of the panel after the building material has cured. As will be understood by the skilled artisan, the building material does not have to be completely cured in order to remove the removable panel from the formwork. The removable panel 25 may be removed whenever the building material has hardened or dried sufficiently to permit the removable panel 25 to be removed from the formwork.

The position of the attachment of the removable panel to the connecting structure may be located at the center position of the formwork, or it may be positioned below or above the center position of the formwork. In any event, when a removable tie is used, the same reinforcement member may be used whether the connection is located near the center, lower or upper positions of the formwork.

In still another aspect of the invention, there is provided a method for making a wall from pourable building material, including the steps of: providing a one-sided wall form having an insulating panel and a connecting structure having a permanent reinforcement sufficient to support the insulating panel during the wall building process; attaching a removable panel to the connecting structure such that the insulating and removable panels define a space for receiving building material; pouring building material into the space between the insulating and removable panels; and disconnecting the removable panel from the wall. The step of attaching the removable panel includes the further step of engaging a coupling, such as a waler, with the connecting structure and attaching the connecting structure to the removable panel by removably fastening the coupling to the removable panel, e.g., by using removable fasteners. The step of disconnecting the removable panel from the wall may include the step of removing the removable panel from the coupling, e.g., by removing the fasteners.

The advantages of the invention include the provision of a conveniently removable panel and an insulating panel with connecting structure that provides sufficient support to the insulating panel and thus avoids the extra material and labor costs associated with prior removable panel formwork that required external supports for the insulating panel which are later removed. In the invention, both the insulating panel and connecting structure supporting the panel are configured to remain a permanent part of the finished wall and constitute the only structure necessary for providing an insulating panel in a one-sided formwork that can withstand the loads caused by the pouring and subsequent curing of the building material.

Additional features and advantages of the invention will be set forth or be apparent from the description that follows. The features and advantages of the invention will be realized and attained by the structures and methods particularly pointed out in the written description and claims hereof as well as the appended drawings.

It is to be understood that both the foregoing general description and the following detailed description are exemplary and explanatory and are intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate preferred embodiments of the invention and together with the description serve to explain the principles of the invention. In the drawings.

DETAILED DESCRIPTION OF THE PREFERRED EMBODIMENTS

Reference will now be made in detail to the preferred embodiments of the invention, examples of which are illustrated in the accompanying drawings.

Figure 1:
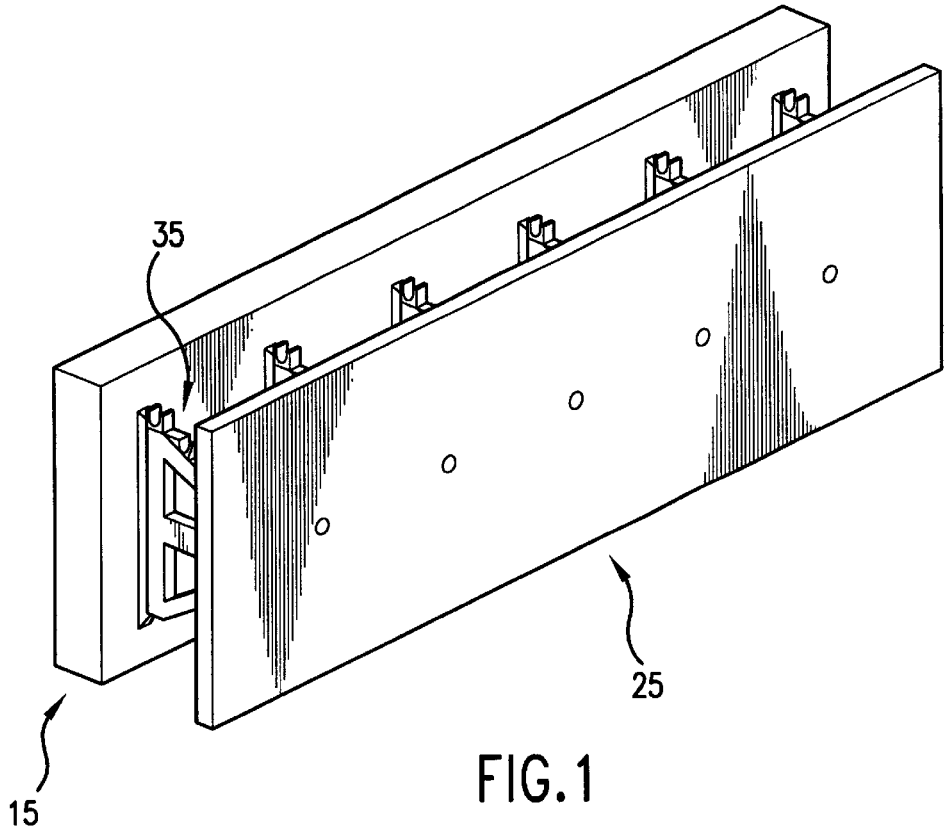
FIG. 1 is an isometric view of a one-sided insulated formwork constructed in accordance with the principles of the invention.
Figure 2:
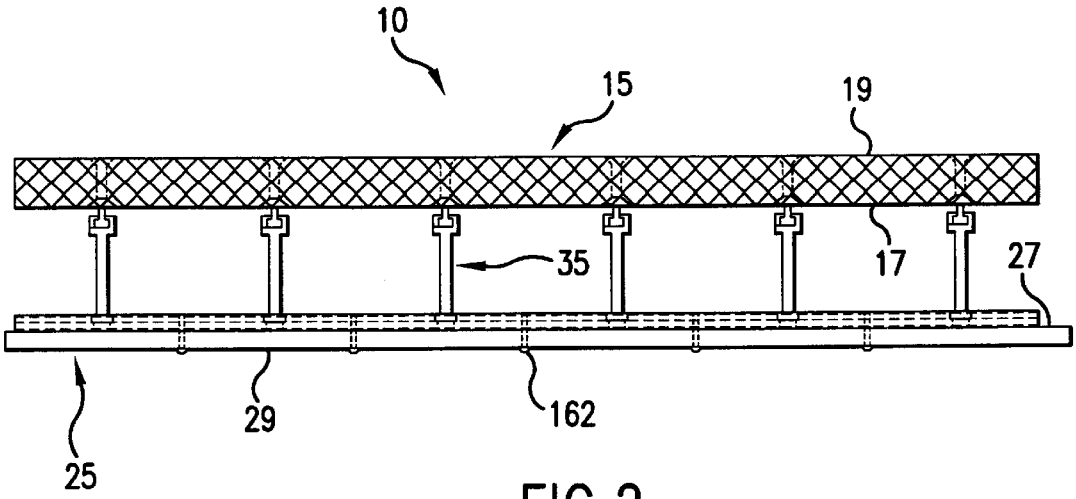
FIG. 2 is a top view of the formwork of FIG. 1.
Figure 3:
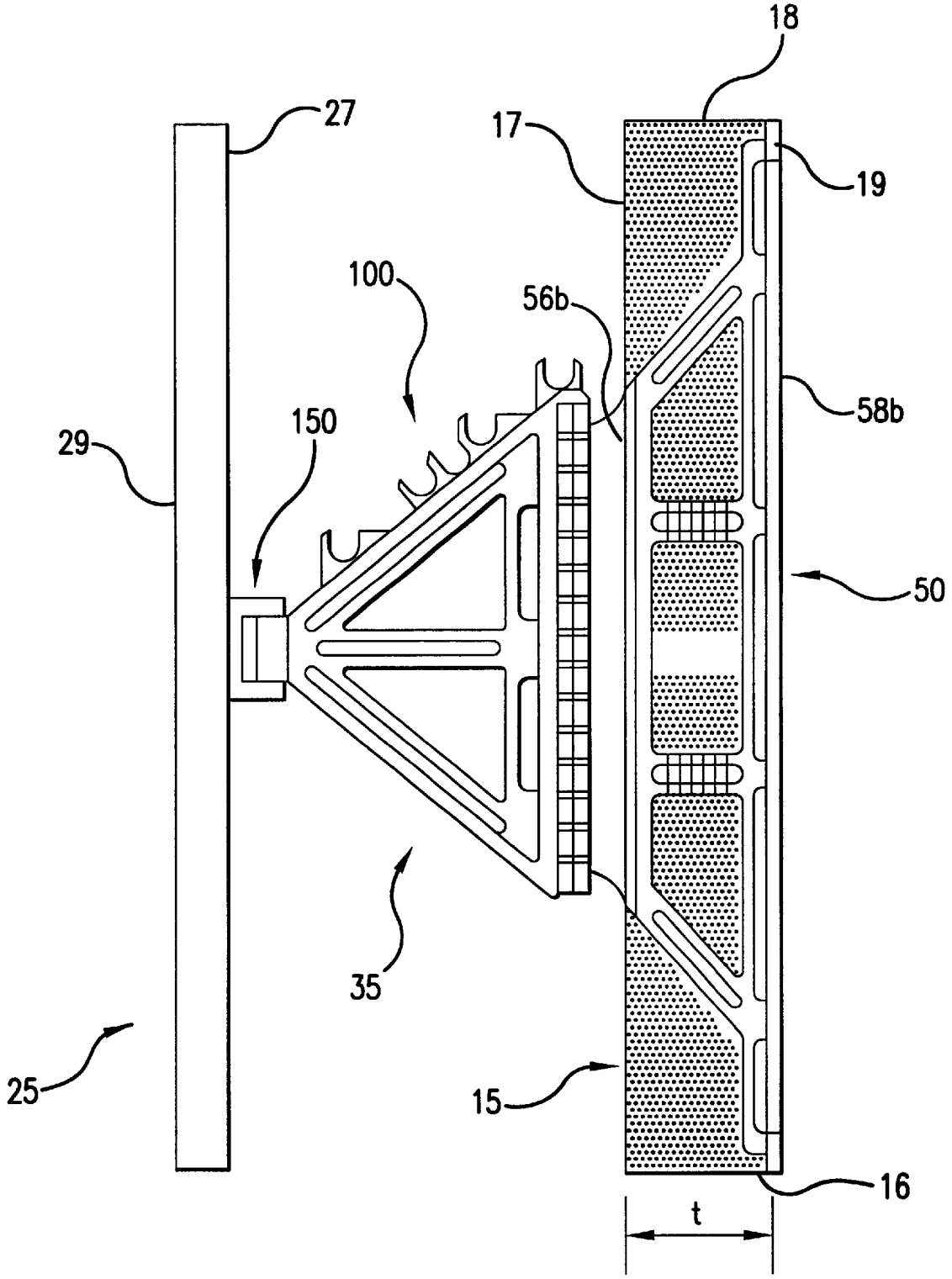
FIG. 3 is a side view, shown partially in section, of the formwork of FIG. 1, illustrating the major components of the invention, including the insulating panel, removable tie and panel web, removable panel, and waler.

FIGS. 1–3 illustrate a first embodiment of a one-sided insulated form 10 constructed in accordance with the principles of the invention. Form 10 is used to build a one-sided insulated form wall for receiving pourable building material, typically by stacking such forms upon each other as is known in the art. Any type of pourable building material may be used with form 10 to construct walls, however, pourable concrete is most commonly used. Form 10 includes a first insulating panel 15, second removable panel 25 and connecting structure 35 extending between and connecting insulating panel 15 to removable panel 25. Connecting structure 35 maintains the two panels in a fixed, spaced relationship during the pouring and curing process of forming a wall from building material. In addition to being usable in the block-type format, the invention may also be used in panel or plank systems.

Insulating panel 15 is connected to removable panel 25 by six connector structures 35 evenly spaced across the length of the form 10. The spacing and/or number of connecting structures 35 for form 10 generally depends on the size of the form, the size of individual connecting structures 35 relative to other parts of the form, and the desired wall thickness, as can be readily determined by a skilled artisan for particular applications. Six connector structures 35 are selected for the typical size of the insulating panel 15, described below.

Referring to FIGS. 2–3, insulating panel 15 is generally of a rectangular shape and includes a bottom end 16, a top end 18, as well as inner and outer surfaces 17, 19 which define a panel thickness t. The inner surface 17 defines a first inner bearing surface of form 10, which, along with a similar surface of removable panel 25, confines the pourable building material, as discussed in more detail below. Along top and bottom ends 16, 18 of panel 15 a series of protrusions and indentations are formed that facilitate the stacking of forms 10 one on top of another, to form a wall formwork. The indentations and protrusions may take any form known in the art, such as that taught in detail in U.S. Pat. Nos. 5,390,459; 5,657,600; and 5,809,727, the disclosures of which are incorporated by reference herein in their entirety. In a typical case, the insulating panel 15 may be 48 inches long, 16¾ in height and 2⅜ inches thick for a 8 inch wall thickness.

Insulating panel 15 remains in place after the building material has sufficiently cured and therefore represents a portion of the finished wall. Panel 15 is made from an insulating soft foamed polymeric material, such as plastic, providing a layer of thermal and/or acoustic insulation to the finished wall. The use of a soft foamed polymeric material or plastic is known in the art, as described, e.g., in U.S. Pat. Nos. 5,390,459, 5,657,600 and 5,809,727. Preferably, the insulating material is Expanded Polystyrene (EPS); however, any other suitable type of insulating material may be used in place of EPS.

Removable panel 25 is detached after the building material has sufficiently cured and therefore represents a temporary panel of the wall formwork. Removable panel 25 includes inner and outer surfaces 27, 29. Inner surface 27 of panel 25 forms a second inner bearing surface of form 10 which, along with inner surface 17 of panel 15, confines the pourable building material. Preferably, removable panel 25 is made from a non-insulating material (e.g., plywood or a hard plastic). Generally speaking, almost any variety of conventional formwork panel may be used for removable panel 25. It is preferred, however, that removable panel 25 be made from a material that has strength properties superior to that of insulating panel 15, as will be discussed in greater detail below.

Although removable panel 25 may have a similar height and length dimension to that of the insulating panel 15 as illustrated in FIG. 1, preferably, removable panel 25 has a height and length dimension that is greater than the corresponding height and length dimensions of the insulating panel 15 so that a single removable panel 25 may be connected to several insulating panels 15 of stacked, one-sided forms 10. In general, the size of removable panel 25 is determined solely by builder preference. For example, a builder may want to use a removable panel 25 that can be connected to several stacked insulated panels 15, or a builder may wish to use a removable panel 25 that is generally the same size as insulated panel 15, depending on, for example, the available sizes of removable panel 25 in the builder's inventory or the size of the wall formwork.

Referring to FIGS. 2 and 3, insulating panel 15 and removable panel 25 are spaced according to the desired wall thickness. When the building material is poured, the first and second inner bearing surfaces, 17 and 27, respectively, confine the building material to the space between the opposed panels. The poured building material loads these bearing surfaces, which define the width of the finished wall.

Referring again to FIG. 3, the connecting structure 35 for the form 10 preferably is formed from a two-piece construction, including a panel web 50, which reinforces insulating panel 15, and removable tie 100. Tie 100 is removably secured at one side to panel web 50, and at its other side to removable panel 25, via a removable panel connection 150, which detachably couples tie 100 to panel 25, thereby facilitating removal of panel 25 after the building material has cured. The connecting structure 35 reacts the loads from the poured building material that tend to push the insulating panel 15 and removable panel 25 apart during the pouring and subsequent curing of the building material.

Panel web 50 provides an internal, built-in reinforcing structure for distributing loads in the soft insulating material of the insulating panel 15. Panel web 50 is preferably made from plastic of sufficient strength to carry the loads encountered during wall construction. The preferred plastic is high density polypropylene, although polyethylene and other suitable polymers, or other relatively high strength materials may also be used. Panel web 50 is preferably secured to the insulating panel 15 by molding the panel web 50 in the insulating panel 15, although other types of insulating panel connections known in the art, such as an interference fit, may be employed. In either case, panel web 50 includes an end plate 58 that can be used to form a furring strip to attach finishing material to the wall. End plate 58 may be embedded completely within the panel 15, or exposed completely or partially on the outer surface 19 of panel 15 as is known in the art. In any case, it is preferred (although not required) for the end plate 58 to extend substantially the full height of the panel 15. End plates 58 on adjacent stacked forms align vertically to provide an easily locatable furring strip. If the end plates are completely embedded within panel 15, any means known in the art to locate the plates, such as templates or spaced protuberances on the panel or panel webs, may be employed.

Tie 100 extends between the insulating panel 15 and removable panel 25. Tie 100 is releasably engageable with the panel web 50 adjacent the first inner bearing surface 17 of the insulating panel 15. While the feature of providing a removable tie 100 constitutes one aspect of the invention, the invention is not limited to connecting structure with a removable tie. As will become apparent to those skilled in the art, the various advantages of the invention are applicable to connecting structures 35 having the tie 100 formed integrally with the panel web 50 (e.g., as when the tie 100 and panel web 50 constitute parts of a monolithic connecting structure 35, such as the unitary bridging member disclosed in U.S. Pat. Nos. 5,390,459; 5,657,600; and 5,809,727.

Reference will now be made in detail to the panel web 50, tie 100 and removable panel connection 150, examples of which are illustrated in FIGS. 2–3, 4A–4B, 5A–5C, 6, 7A–7C, and 8A–8B.

Figure 4A:
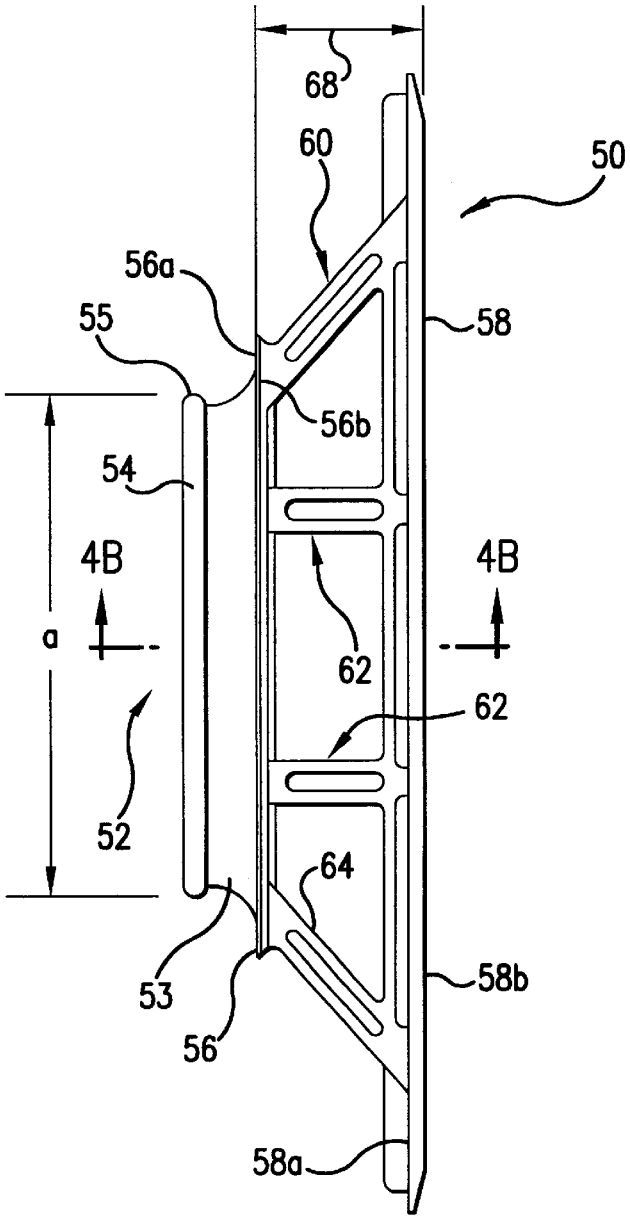
FIG. 4A is a side view of a panel web, which internally reinforces the insulating panel and forms one part of the panel connecting structure of the invention.

Referring to FIGS. 2–4, panel web 50 may be embedded in the insulating panel 15 by conventional means known in the art, such as by placing the panel web 50 into a panel mold, injecting foamable plastic into the mold (e.g., polystyrene), and removing the panel 15 with embedded panel web 50 from the mold after the plastic has cured. Panel web 50 may also be embedded by providing a transverse slot in the insulating panel 15 so that the panel web 50 may be slidably received within a slot, as is known in the art and as disclosed in, for example, U.S. Pat. No. 5,065,561 to Mason, the disclosure of which is incorporated by reference herein in its entirety. Panel web 50 is embedded in the insulating panel 15 such that an inner surface **58*a* of the end plate 58 (see FIG. 4A) lies against the outer surface 19 of insulating panel 15 and an inner surface 56*a* on the opposite side of panel web 50 lies against the first inner bearing surface 17**.

As noted above, end plate 58 may be fully exposed and visible on the outer surface 19 of panel 15, exposed only along a portion of its length (partially exposed), or completely embedded within panel 15. Preferably, outer surface 56*b* lies flush with first inner bearing surface 17 and outer surface 58*b* lies flush with outer surface 19 (as best shown in FIGS. 3 and 8B). However, either or both of the outer surfaces 56*b* and 58*b* may be recessed within panel 15.

Figure 6:
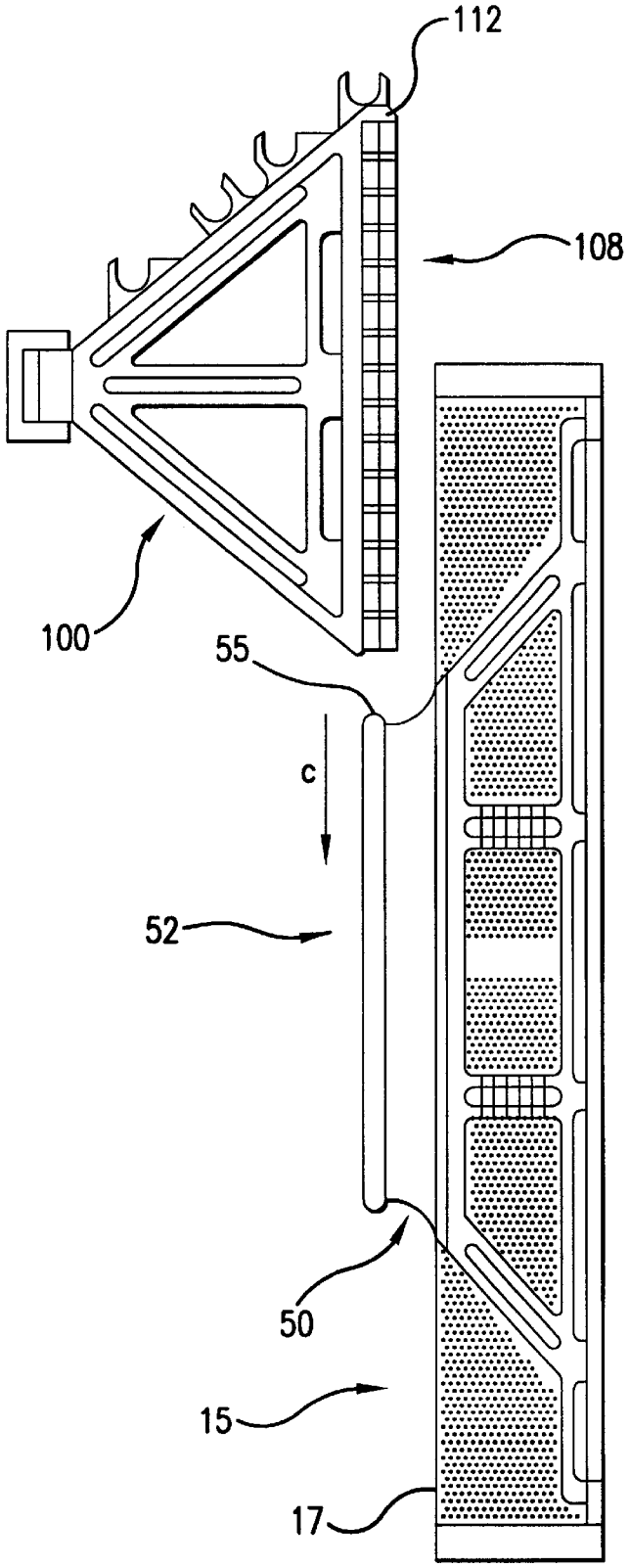
FIG. 6 is a side view showing how the panel web and removable tie are slidably connected.

As shown in FIG. 4*a*, opposite end plate 58 is a male connector 52 for removably connecting tie 100 to panel web 50. When the panel web 50 is connected to the insulating panel 15, male connector 52 extends outwardly from the first inner bearing surface 17 of the insulating panel 15, as shown in FIG. 6. Tie 100 is connected to the panel web 50 by engaging a female connector 108 formed on tie 100 with male connector 52 disposed adjacent the first inner bearing surface 17 of the insulating panel 15, in a manner described in more detail subsequently. The engagement is secure, but may be removable or permanent, such as by use of a snap-fit or detent-type connection, or other connections known in the art.

Figure 4B:
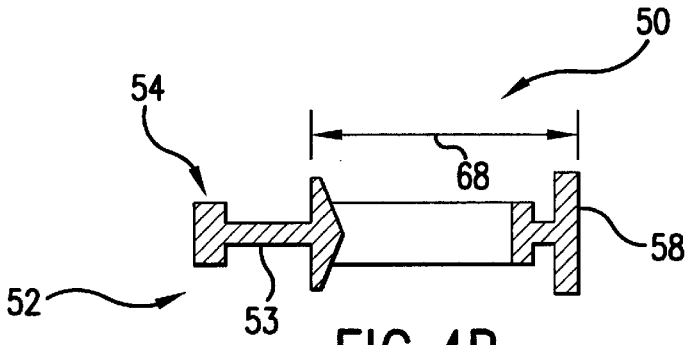
FIG. 4B is a cross section view of the panel web of FIG. 4A taken along line 4B—4B.

Referring to FIGS. 4A and 4B, end plate 58 is connected to male connector 52 by a pair of horizontal truss members 62, an upper diagonal truss member 60 and lower diagonal truss member 64. End plate 58 provides a loading surface for insulating panel 15 to react building material loads transferred to the panel web 50 from the tie 100. The combination of horizontal truss members 62 and upper and lower diagonal truss members, 60 and 64 transfer loads transmitted from the tie 100 to the panel web 50 relatively evenly from top to bottom along the span of the end plate 58, which may extend across substantially the full height of panel 15. Panel web 50 distributes a relatively even loading across the panel 15, thereby reducing stress concentrations in the panel 15 and preventing failure of the relatively weak panel 15 during the wall building process.

Form 10 does not require externally applied pressure forms, braces, or other such structural supporting material known in the art because panel web 50 provides sufficient support for insulating panel 15 by distributing the building material loads across a surface area sufficient for reducing stress concentrations in the insulating panel 15. Panel web 50 may therefore be used as the sole means for reinforcing the panel 15. When loads are distributed across the formwork panel, stress concentrations induced in the panel 15 by the pouring and subsequent curing of the building material in the panel 15 are reduced when the load can be distributed across a larger portion of the panel surface (either an internal or external surface). For the typical design (as shown in FIGS. 2 and 3), panel web 50 reduces stress concentrations below the ultimate stress (i.e., the stress level that will fail the material) so that the insulating panel can sustain loads during the wall building process. For a particular application, the amount of load distribution needed to prevent failure of the insulating panel will depend on many factors, the more influential of which may be whether the net load transferred to/from the connecting structure to the insulating material will exceed the ultimate allowable stress of the insulating material. This determination is well within the capabilities of the skilled artisan.

Figure 5A:
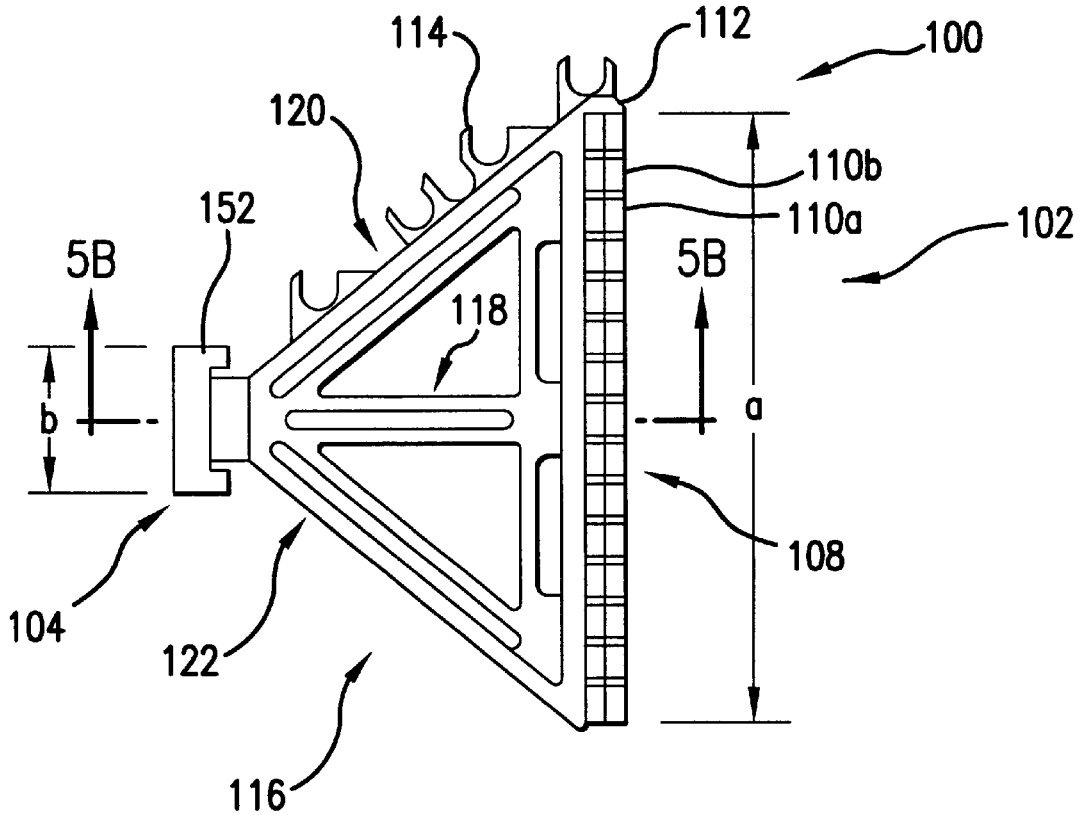
FIG. 5A is a side view of the removable tie, which forms the other part of the panel connecting structure of the invention.
Figure 5B:
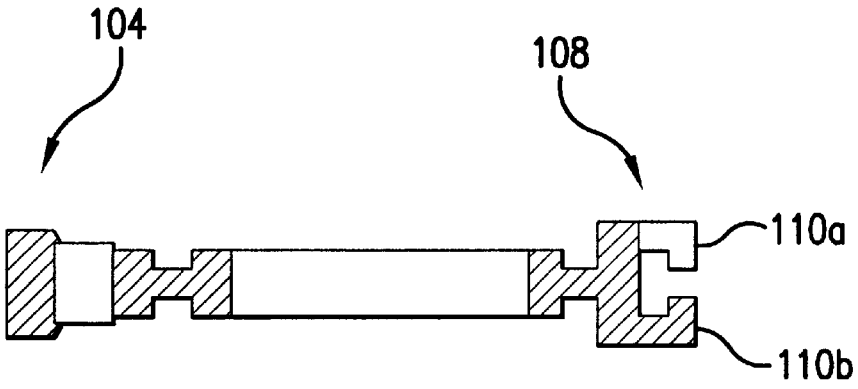
FIG. 5B is a cross section view of the removable tie of FIG. SA taken along line 5B—5B.
Figure 5C:
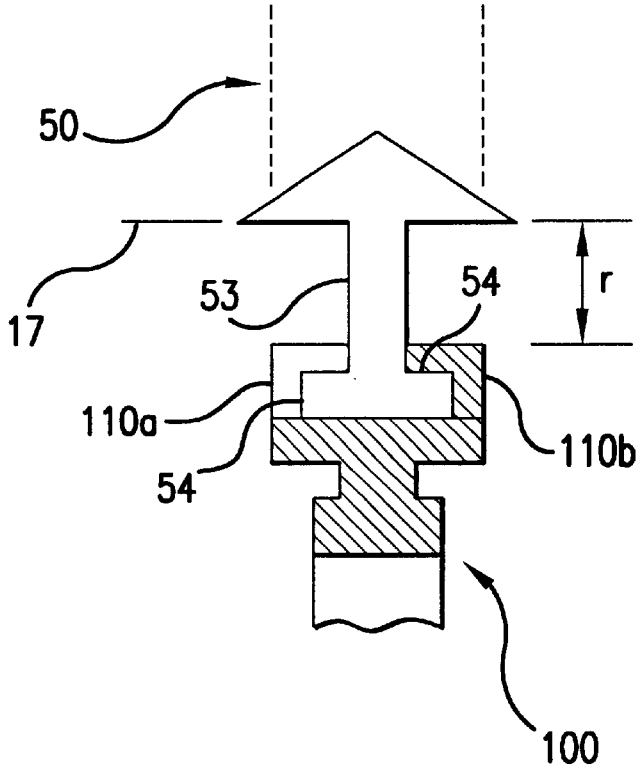
FIG. 5C is an enlarged view of the connection between the removable tie and panel web of the invention.

Referring to FIGS. 5A–5C, removable tie 100 may be a monolithic structure, including an insulating panel connecting end 102 and a removable panel connecting end 104. Tie 100 is preferably made from plastic. The preferred plastic is high density polypropylene, although polyethylene and other suitable polymers or other material of suitable strength may also be used. Connecting end 102 includes the side of the tie 100 where female connector 108 is formed and corresponds to the side of the tie 100 connected to the male connector 52 of panel web 50. Connecting end 102 has an insulating panel connecting length a described below.

Removable panel connecting end 104 corresponds to the end of the tie 100 where the removable panel connection 150 is provided. Formed on the removable panel connecting end 104 is a connector piece 152 having a removable panel connecting length b, which is smaller than connecting length a. As will be discussed in greater detail below, the connecting length b is related to the strength of removable panel connection 150 and removable panel 25.

Referring again to FIG. 5A, between ends 102, 104 tie 100 has a generally tapered mid-section 116, which includes a horizontal member 118, an upper diagonal member 120, and a lower diagonal member 122. The result is a generally triangular-shaped tie that is asymmetric about its vertical midpoint. A series of rebar hooks 114 are formed along the top end of diagonal member 120 to allow rebar to be secured to the form 10. The rebar hooks are provided for securing rebar in the formwork.

The asymmetric design of tie 100 facilitates transferring loads between panels 15 and 25 via connecting end 102 (which transfers loads to/from panel 15 across the full length of connecting length a) and connecting end 104 (which transfers loads to/from panel 25 across connecting length b). Tie 100 is asymmetric since the connecting lengths a and b of connecting ends 102 and 104, respectively, are of different lengths. As is discussed in greater detail below, the asymmetric nature of tie 100 reflects the difference in the relative strength of materials of the removable panel 25 and insulating panel 15, and further offers heretofore unrecognized advantages over conventional symmetric ties.

As was mentioned earlier, removable panel 25 may be made from a non-insulating material (e.g., plywood or hard plastic) preferably having strength characteristics superior to that of the material used for the insulating panel 15. When the removable panel 25 is made from such a strong material, the loads transferred from the tie 100 to the removable panel 25 can be concentrated in a relatively small area compared to the loads transferred to the insulating panel 15. Thus, the second panel connecting length b can be reduced in size relative to the first panel connecting length a. A suitable length for connecting length b for a particular application depends upon many design factors, all of which are readily determinable by one skilled in the art. Among the more influential factors are the material used for the removable panel 25 and the spacing between connecting structures 35 of the formwork. For example, if a foam plastic panel were used as panel 25, connecting length b would approximate connecting length a, whereas if a thick plywood panel were used, connecting length b could be substantially less than connecting length a.

Obviously, there is no requirement that the connecting length b of removable panel connecting end 104 be less than connecting length a of the insulating panel connecting end 102 to be able to remove the removable panel 25. However, there are two advantages realized when dissimilar panels are used for the formwork and the connecting length b associated with the removable panel 25 is reduced relative to the connecting length a for the insulating panel 15. First, the size of the tie 100 can be reduced accordingly. This is desirable as it increases the structural integrity of the finished wall by reducing the amount of space occupied by connecting structure disposed in the space for the building material. The generally triangular shape of the asymmetric tie 100 of the invention is exemplary in this regard, but obviously other asymmetric shapes could be used. Second, the labor and material associated with attaching and removing the removable panel 25 can be greatly reduced because connecting length b may be reduced substantially relative to the connecting length a. For example, in the preferred embodiment, conventional removable fasteners such as self-tapping screws 162 may be used to connect removable panel 25 to a single coupling mechanism, such as a waler 154. Waler 154 may then be used to secure several connecting structures 35 to the removable panel 25 since the connecting end 104 of asymmetric tie 100 is reduced to an appropriate size for conveniently slidably engaging waler 154, as described below.

The details of the connection between the tie 100 and panel web 50 will now be described with reference to FIGS. 4A, 4B and 5A–5C. The male connector 52 of panel web 50 has a T-shape formed by head 54 extending transversely across the end of an elongate extension 53. The extension 53 depends outwardly from vertical portion 56 of the panel web 50. The male connector 52 is adapted to be received in female connector 108 formed on tie 100, as shown in FIGS. 5A–5C. Female connector 108 may include a plurality of L-shaped engagement flanges 110*a* and 110*b*, which form a positive engagement (e.g., an interference fit) with the T-shaped head 54 of connector 52, as shown in FIG. 5C. Referring to FIG. 5A, the L-shaped flanges 110*a* and 110*b* are formed along substantially the entire connecting length a of the tie 100 and alternate from each side of tie 100 as shown in FIG. 5C. Similarly, T-shaped head 54 and extension 53 of connector 52 of the panel web 50 may extend over the same connecting length a, as shown in FIG. 4A. Thus, the tie 100 forms a positive engagement with the panel web 50 along a first panel connecting length a. Referring to FIG. 6, when the tie 100 is being connected to the panel web 50, the L-shaped flanges 110*a* and 110*b* of the female connector 108 slide over the corresponding T-shaped head 54 of connector 52 in the direction c. At the upper end of the female connector 108 is a supporting endpiece 112 that rests against the top end 55 of the male connector 52 and forms a stop when the tie 100 is fully slid over panel web 50. End piece 112 may engage end 55 with a snap-fit, in a manner known in the art, to positively lock and position the tie 100 and panel web 50 together in a predetermined relationship.

Other changes in the connection could be made. For instance, male connector 52 could be formed on the tie 100 and female connector 108 could be formed on the panel web 50. However, it is desirable to have the T-shaped head 54 of connector 52 formed on the panel web 50 for the following reason. Referring to FIG. 5C, by placing head 54 of the T-shaped connector 52 on the panel web 50 and at the end of extension piece 53, a clearance r is formed between the inner bearing surface 17 and the L-shaped flanges 110*a*, 110*b* of the female connector 108. With this arrangement, the building material can flow into the clearance. As the building material fills the formwork, the pressure on the male/female connection will assist in maintaining a secure connection between the tie 100 and panel web 50. In addition, other connector types known in the art can readily be used in place of the illustrated male and female connectors. For example, key hole slots engaged with a flanged post, posts inserted into holes disposed at right angles to the load bearing direction, or hook members received in corresponding slots could be used. While the above-described connection provides a secure yet removable fit, the connection could be made permanent by any conventional means known in the art. In addition, if site adjustable wall thickness for the form 10 is not needed or desired, tie 100 and panel web 50 can be integrally formed, such as disclosed in the aforementioned U.S. Pat. Nos. 5,390,459, 5,657,600, and 5,809,727.

Figure 7A:
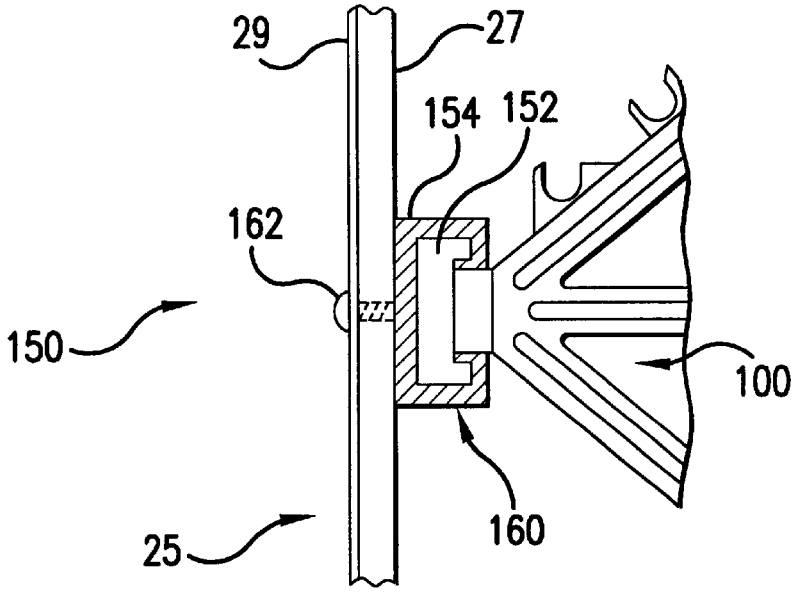
FIG. 7A is an enlarged view of a removable panel connection between the removable tie and removable panel of the invention.
Figure 7B:
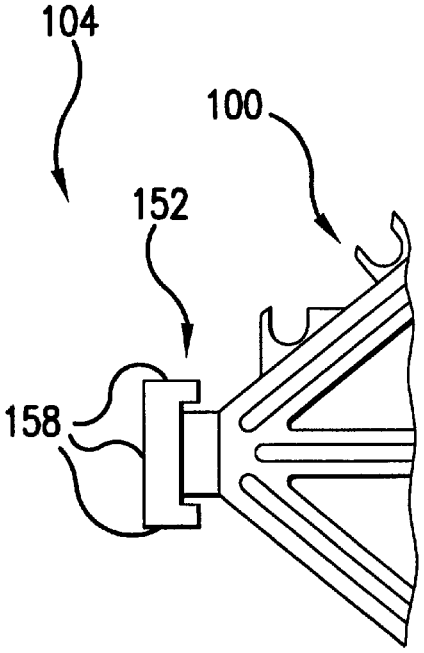
FIG. 7B is an enlarged view of the tie of FIG. 3 showing the connector portion of the removable tie.
Figure 7C:
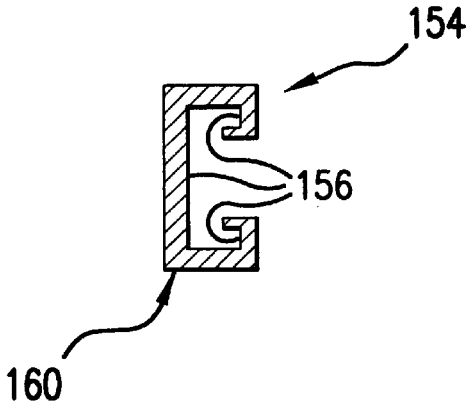
FIG. 7C is a side view of the waler portion of the removable panel connection.

The removable panel connection 150 will now be described in detail with reference to FIGS. 7A–7C and 8A–8B. Referring to FIGS. 7A–7C, removable panel connection 150 is formed by connector piece 152 disposed at the connecting end 104 of tie 100, a waler 154 releasably engageable and disengageable with connector piece 152, and a removable fastener 162 securing the waler 154 to the second inner bearing surface 27 of the removable panel 25.

Referring to FIG. 7C, waler 154 is preferably a channel 160 having a C-shaped cross section made from steel or a steel alloy. Channel sections of other shapes or other types of structural members with suitable strength may also be employed as the skilled artisan will recognize. Referring to FIG. 7B, connector piece 152 includes a peripheral surface area 158 that engages the inner surfaces 156 of the C-shaped channel 160. The surface area 158 of connector piece 152 is shaped to fit snugly within the inner surfaces 156 formed by channel 160. Connector piece 152 is preferably made from the same material as other portions of tie 100. However, it is contemplated in an alternative embodiment of the removable panel connection 150 (discussed below) that the connector 152 be made of a stronger material than the remaining portions of tie 100 (which are preferably made from molded plastic).

Figure 8A:
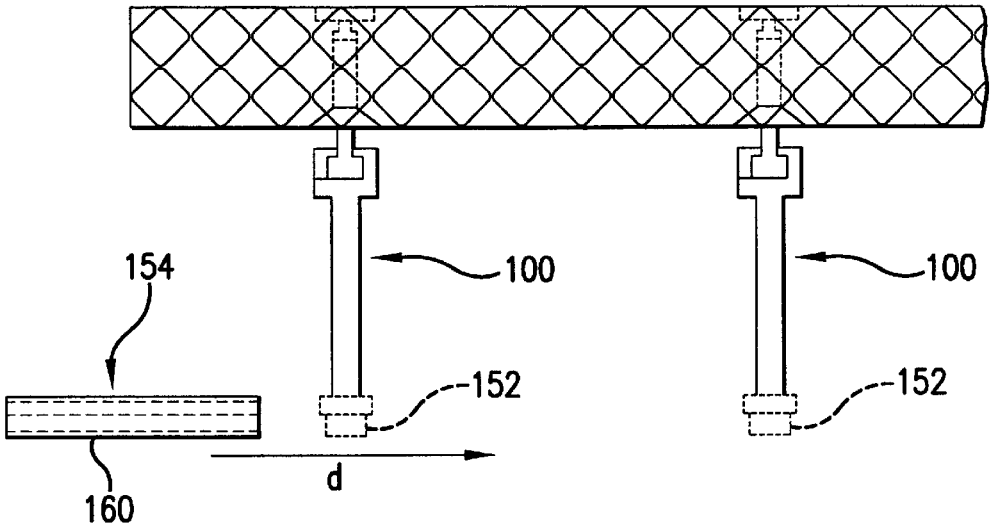
FIG. 8A is a top assembly view showing the sliding engagement of the waler on two of the ties of the invention.
Figure 8B:
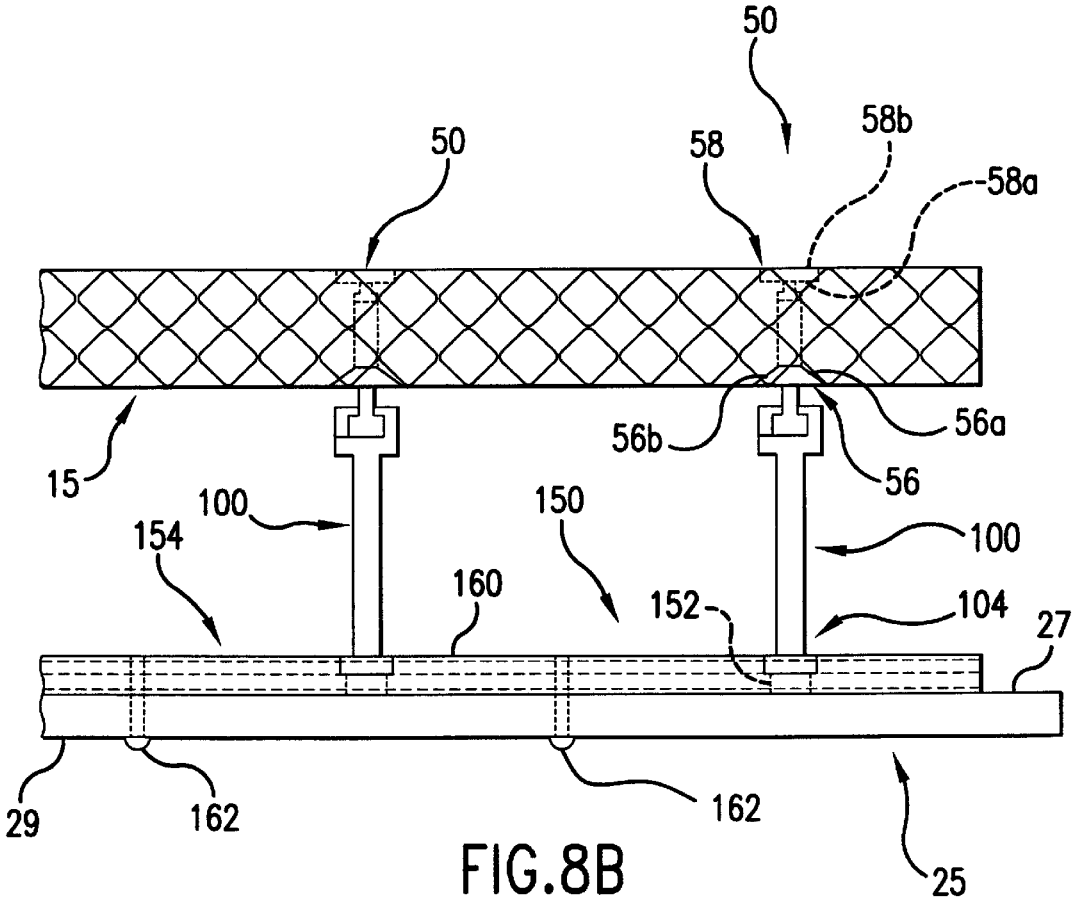
FIG. 8B is an enlarged view of the formwork of FIG. 2 showing the removable connection between the fastener, waler, tie and removable panel of the invention.

Referring to FIG. 8A, channel 160 is connected to connector piece 152 by sliding engagement as indicated by directional arrow d, which is perpendicular to the tie connection and assembly lengths a, b, c. Thus, channel 160 is slidingly engaged with connector piece 152 along a horizontal axis, whereas the tie 100 is slidingly engaged with the panel web 50 along a vertical axis (compare FIGS. 6 and 8A). Channel 160 can be slidingly engaged with one or more connector pieces 152 of connecting structure 35. In the design shown in FIG. 2, channel 160 engages six connector pieces 152. In general, the number of connecting structures 35 or ties 100 that can be engaged with channel 160 is dependent only upon the length of channel 160.

After connector piece 152 has been mated with channel 160, removable panel 25 is secured to channel 160 by removable fasteners 162. Preferably, the removable fastener 162 is a self-drilling and self-tapping screw or other type of self-adhering conventional removable fastener that is adequate for securing the channel 160 to the removable panel 25. In general, the number of removable fasteners 162 generally depends on builder preference. Five removable fasteners 162 are used to connect a channel 160 to the removable panel 25 of the form 10 shown in FIG. 2. The number of removable fasteners may vary depending on the size and strength of the fastener and the strength and stiffness of the channel 160. Thus, the loads transmitted from the tie 100 to the removable panel 25 are carried through the removable fasteners 162.

Figure 9:
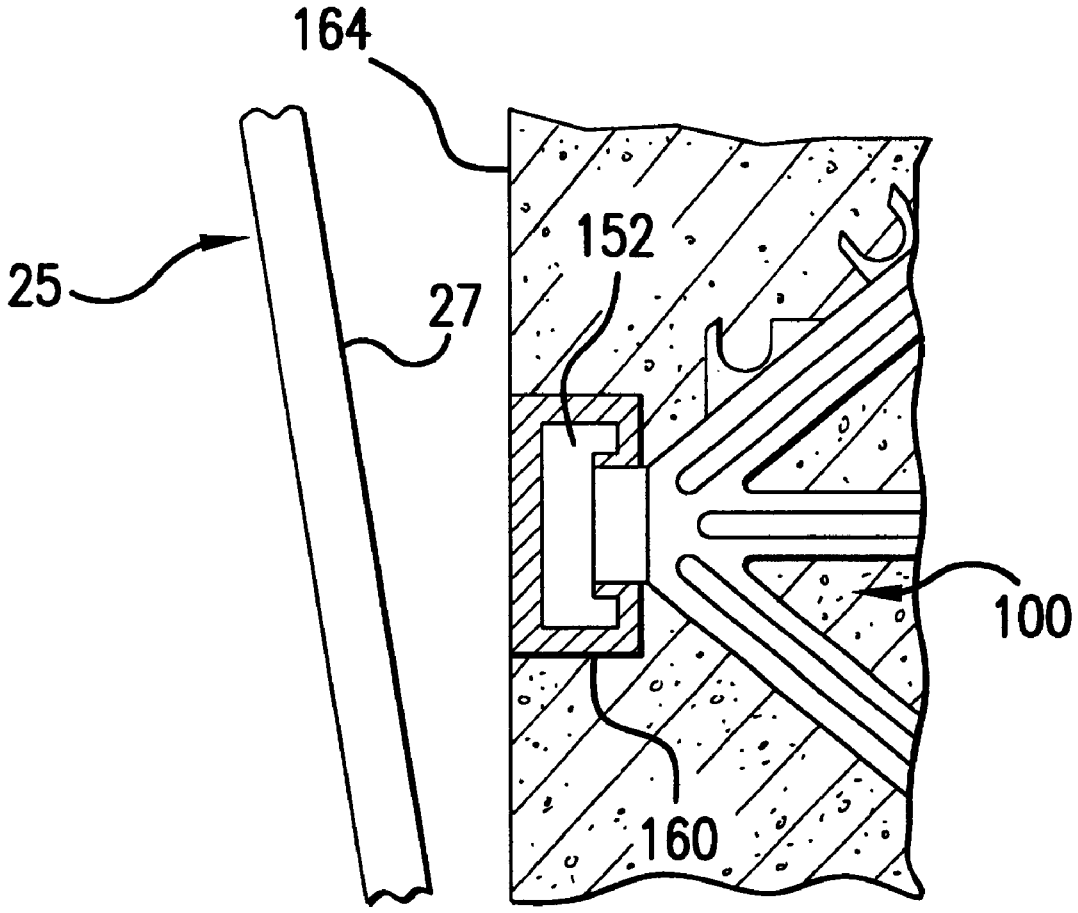
FIG. 9 is a side view of the invention, shown in partial cross section, illustrating disassembly of the formwork with cured building material contained therein.

Referring to FIGS. 7A and 9, after the building material has sufficiently cured, removable panel 25 is detached by first removing the removable fasteners 162. Channel 160, which was previously in contact with the removable panel 25, is now left in the formwork, and embedded in the wall outer surface 164 where it remains engaged with connector piece 152. The outer surface of channel 160 is flush with the outer surface 164 of the finished wall, as shown in FIG. 9.

Figure 10A:
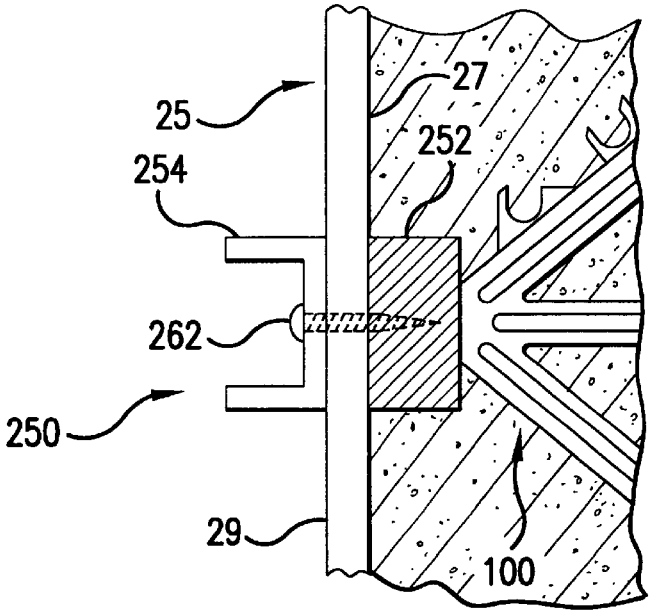
FIG. 10A is an enlarged side view, shown in partial cross section, of an alternative embodiment of the removable panel connection of the invention.
Figure 10B:
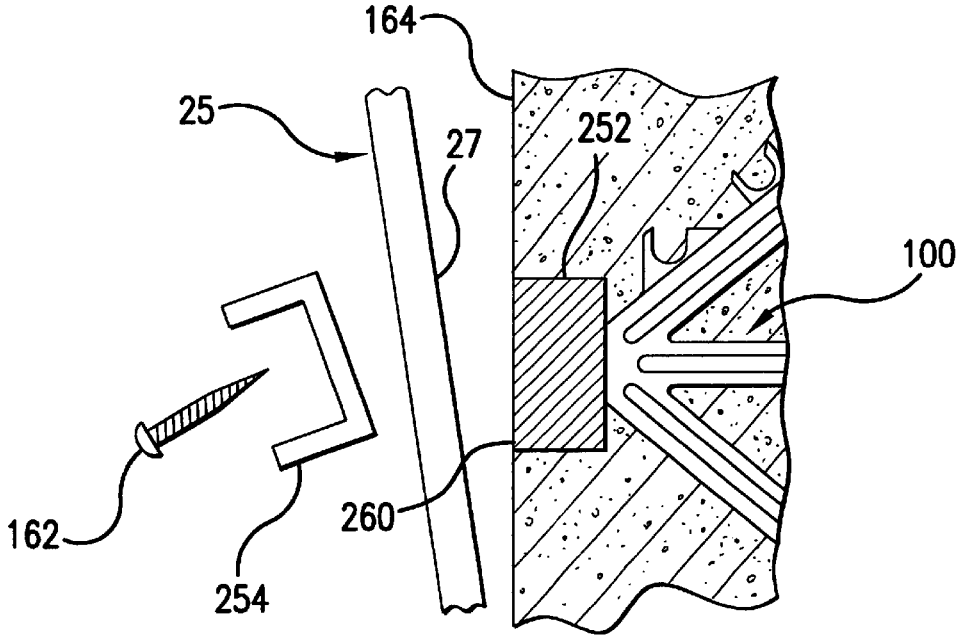
FIG. 10B is an enlarged side view of the alternative embodiment of the removable panel connection, shown in partial cross section, illustrating disassembly of the formwork.

In an alternative embodiment of the removable panel connection 150, as shown FIGS. 10A and 10B, a waler 254, also in the form of a C-shaped channel member, may be placed on the outer surface 29 of the removable panel 25 and a removable fastener 262 (such as a self-tapping screw) is then used to directly secure both the waler 254 and a connector piece 252 of the tie 100 to the removable panel 25. This embodiment of removable panel connection 150 allows the waler 254 to be used in subsequent applications since it is not embedded in the finished wall when the removable panel 25 is removed. In addition, the finished wall does not have an exposed waler along the wall outer surface 264. Although a C-shaped section is used for waler 254, any conveniently shaped section may be used instead since the waler 254 is not used to provide a sliding connection for the connecting end 104 of the tie 100 (as is the case with waler 154). The waler 254 may have pre-formed holes for the removable fastener 262, which are positioned at locations on the removable panel 25 where the connector piece 252 is in contact with the second inner bearing surface 27 of form 10. Waler 254 is detached along with the removable panel 25 after the building material has cured. Since the connector piece 252 is secured directly to the removable panel 25 using the removable fastener 262, it may need to be made of a stronger material than the other portions of tie 100, which may be made from plastic as noted above. For example, steel, a steel alloy, or fiberglass can provide the necessary added strength to the connector piece 252 so that it can securely hold the removable fastener 262 when the formwork is subjected to loads.

In the known formwork that use stacked block-type forms to construct a wall formwork, there is often times a need to secure an upper block to an adjoining lower block of the wall to prevent separation between the blocks when the building material is poured. A typical approach for securing the upper and lower blocks is to tape the insulating panel of the upper formwork to the insulating panel of the lower formwork. The tape will prevent the upper form from separating from the lower form as the upper form is being filled with building material. In the case of a wall formwork constructed using a series of stacked one-sided forms 10 connected to a removable panel 25 spanning several stacked insulating panels 15, it has been found that there is a special need for preventing separation between an upper and lower insulating panel of two adjoining one-sided forms 10. This separation between adjoining insulating panels 15 is due to a net upturning moment induced in the upper form 10 when the building material has only partially filled the upper form 10. The moment is due, in part, to the use of a single removable panel 25 connected to several one-sided forms 10, as would be readily understood by the skilled artisan.

Figure 11A:
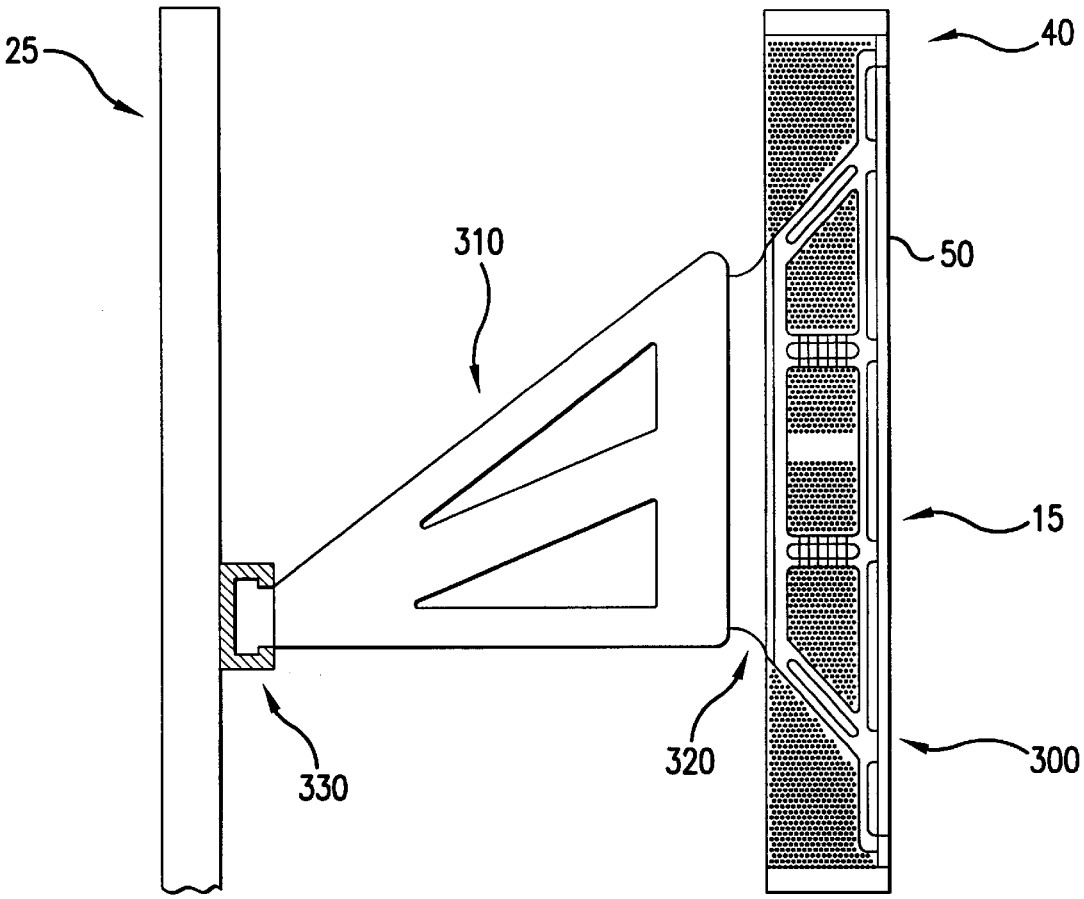
FIG. 11A is a side view of a second embodiment of the invention showing a tie connecting the insulating panel to the removable panel at a position below the center position of the formwork.

It has been found that the above-identified separation problem can be avoided by adjusting the vertical position of the one-sided form 10 connection to the removable panel 25. Such a formwork is contemplated in a second embodiment of the invention which will now be described with reference to FIG. 11A.

In the above described first embodiment of the invention, removable panel connection 150 is positioned for attachment to the removable panel 25 at a mid-height or center position of the formwork. Referring FIG. 11A, in the second embodiment of the invention there is shown a one-sided form 300 with a tie 310 adapted for connecting the insulating panel 15 to the removable panel 25 below the center position of the formwork. In this embodiment, tie 310 may utilize the same connecting means described above at the insulating panel connecting end 320 and removable panel connecting end 330. Tie 310 differs from tie 100 of the first embodiment in that tie 310 is asymmetric about both its vertical and horizontal midpoints (whereas tie 100 is symmetric about its horizontal midpoint). The horizontal asymmetry of tie 310 is a result of the desire for connecting removable panel 25 below the center position of the formwork while allowing tie 310 to be connectable to the same panel web 50 connection as was used in form 10 of the first embodiment. Tie 310 preferably takes the shape of a right triangle, however, tie 310 may also take on a generally skewed triangular shape if, for example, it is desirable to have insulating panel 15 connected to removable panel at an arbitrary position below the center position of the formwork.

When form 300 is utilized in a formwork, the lower positioned connection to the removable panel 25 will minimize the separation effect described previously because the resultant loads induced in the partially filled formwork will tend to reduce a net upturning moment, as would be readily understood by the skilled artisan. Of course, form 300 is not required in formwork constructed using the one-sided form since the separation problem can be avoided by simply taping the upper and lower insulating panels 15 of the formwork. However, form 300 is preferable over using tape since the chore of taping together all of the insulating panels 15 can be labor intensive.

Two additional approaches are contemplated for avoiding the separation problem described above. Both of these approaches are readily usable with the one-sided form, or any other type of block-type insulated formwork, as will be apparent to the skilled artisan. The first approach is to use vertical, U-shaped wire ties manually inserted on one end to the insulating panel 15 of the upper formwork and at the other end to the insulating panel 15 of the lower formwork. The second approach is to use a vertical, tie-to-tie connecting member for connecting the tie of the upper formwork to the tie of the lower formwork. In either case, the separation problem is avoided since a vertical connection is made between the upper and lower formwork.

Figure 11B:
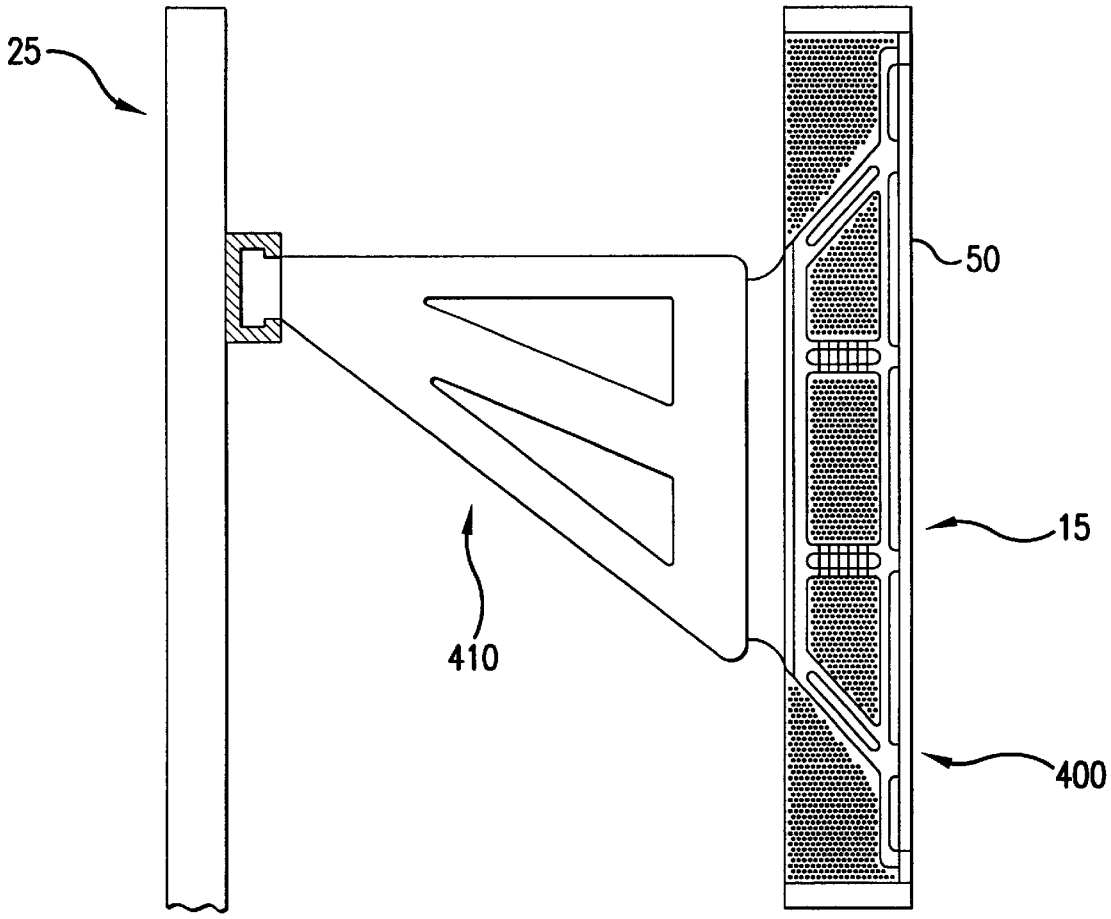
FIG. 11B is a side view of a third embodiment of the invention showing a tie connecting the insulating panel to the removable panel at a position above the center position of the formwork.

Referring now to FIG. 11B, in a third embodiment of the invention there is shown a one-sided form 400 with a tie 410 adapted for connecting the insulating panel 15 to the removable panel 25 above the center position of the formwork. One-sided form 400 is the same as one-sided form 300 except that the removable panel 25 is connected to insulating panel 15 above the center position of the formwork. One-sided form 400 is contemplated for use with blocks positioned along the upper end of a wall formwork to provide added stiffness to the removable panel 25 top edge. By re-positioning the insulating panel 15 connection above the center position of the formwork, removable panel 25 may be stiffened at the upper edge.

As should now be apparent to the skilled artisan, whereas form 300 will tend to eliminate the separation problem, form 400 exacerbates the separation problem since the removable panel connection 25 is above the center position of the formwork. Accordingly, when form 400 is used to stiffen the upper edge portion of removable panel 25, there is a need for providing a vertical connection, e.g., the U-shaped wire tie, tie-to-tie connecting member or tape, between the upper and lower formwork.

The assembly and disassembly of the form 10, which should be apparent to the skilled artisan from the description above, proceeds as follows. The insulating panel 15 with connected panel web 50 is attached to the tie 100 by connecting the male connector 52 of the panel web 50 to the female connector 108 of the tie 100. If the tie 100 and panel web 50 are formed integrally, this step is obviously skipped as the tie 100 and panel web 50 are already connected. The integral tie and web member would be connected to the insulating panel 15 (for example, during the panel molding process, as is known in the art). In the removable tie embodiment, the tie 100 is selected according to the desired wall thickness after the first panel with embedded panel web 50 has been formed. The removable panel 25 is then connected to the connecting end 104 of the tie 100 by waler 154 or 254 and fastening the removable panel 25 to the waler using one or more removable fasteners 162 or 262. The panels are now ready to receive the building material (e.g., pourable concrete) in the space defined by the first inner bearing surface 17 and second inner bearing surface 27. After the building material has been poured and subsequently cures, the removable panel 25 may be detached and removed. The removable panel 25 is detached by removing the removable fasteners 162 or 262 connecting the removable panel 25 to the waler 154 or connector piece 252.

Figure 12:
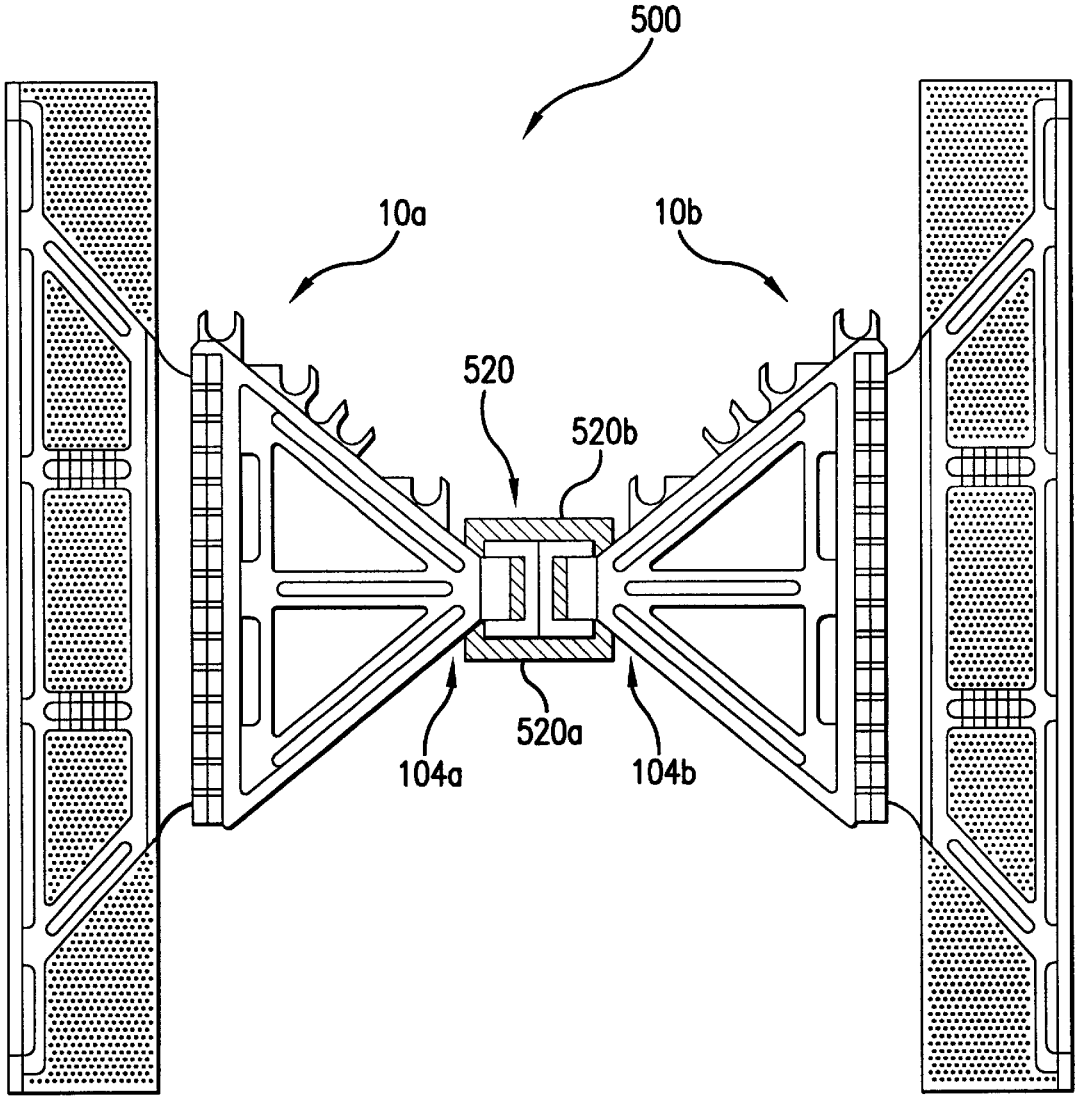
FIG. 12 is a side view of a fourth embodiment of the invention showing a formwork constructed by connecting two one-sided forms to a center connector.

A fourth embodiment of the invention will now be described in detail with reference to FIG. 12. Referring to FIG. 12, there is described a formwork 500 assembled by coupling together a first and second one-sided form 10*a*, 10*b* at their respective removable panel connecting ends 104*a*, 104*b* using a center connector 520. Form 500 has two permanent, opposed insulating panels with the space therebetween defining the space for pouring building material. Center connector 520 includes a first and second connecting end 520*a*, 520*b*. Preferably, center connector 520 is a clip with an I-shaped cross-section. Center connector 520 may also take on other forms, as will be apparent to the skilled artisan, for example, a pair of walers 154, connected back-to-back. A wire wrapped around each of the ends of the ties 100 may also be used in place of connector member 520.

We claim:

1. A one-sided insulated wall form for use with a removable panel defining with the insulated wall form a space for receiving pourable building material, said one-sided insulated wall form comprising:

a permanent panel having a first length defined as the distance between a first side and a second side of said permanent panel, and a surface defining at least a portion of an outer wall surface of a wall constructed with the form, said permanent panel being made from an insulating; material configured to remain a permanent part of the wall; and a connecting structure for maintaining a fixed, spaced relationship between said permanent panel and the removable panel, said connecting structure configured to remain a permanent part of a wall constructed with the formwork, said connecting structure including:

a longitudinally extending first portion connectable to said permanent panel, said first portion having a second length approximately equal to at least one half of the first length of said permanent panel, the second length being defined by a panel support for distributing building loads across a region of said permanent panel, the building loads being sufficiently distributed by said panel support to permit support of said permanent panel by said first portion during the wall building process, and a second portion releasably engageable with the removable panel.

2. A formwork comprising the one-sided insulated wall form of claim 1 in combination with a removable panel made from a non-insulating material, said removable panel being releasably secured to the one-sided insulated form by engagement of said removable panel with said second portion.

3. The one-sided insulated wall form of claim 1, wherein said first portion comprises a reinforcement member secured to said permanent panel and said second portion comprises a tie connected to said reinforcement member.

4. The one-sided insulated wall form of claim 3, wherein said reinforcement member is embedded within said permanent panel by molding.

5. The insulated wall form of claim 3, wherein said reinforcement member and tie member are integrally formed.

6. The one-sided insulated wall form of claim 3, wherein said reinforcement member is slidably received in said permanent panel.

7. The one-sided insulated wall form of claim 6, wherein said permanent panel includes a slot and said reinforcement member includes a shank configured to be slidably received within said slot.

8. The insulated wall form of claim 1, wherein said first portion comprises a reinforcement member and said second portion comprises a tie member detachably securable to said reinforcement member.

9. The insulated wall form of claim 8, wherein said reinforcement member includes a first portion integrally formed therewith and said tie member includes a second portion integrally formed therewith, wherein said tie member is detachably securable to said reinforcement member by engaging said first and said second portions.

10. The insulated wall form of claim 9, wherein one of the first and second portions comprises a male connector and the other comprises a female connector adapted to positively engage said first and second portions together.

11. The insulated wall form of claim 9, wherein when the removable panel is engaged with said second portion and the pourable building material is disposed between said permanent panel and said first and second portions, the pourable building material assists in forming the connection between the tie member and the reinforcement member.

12. A one-sided insulated wall form for use with a removable panel defining with the insulated wall form a formwork for receiving pourable building material, said one-sided insulated wall form comprising:

a permanent insulating panel having a surface defining at least a portion of an outer wall surface of a wall constructed with the form, said permanent panel including a reinforcement member for distributing building loads across a region of said permanent panel, the building loads being sufficiently distributed by said reinforcement member to permit support of said permanent panel by said reinforcement member during the wall building process; and a tie member having a first end releasably engageable with said reinforcement member and a second end having a panel connecting portion being couplable to the removable panel and de-couplable from the removable panel after the pouring of the building material.

13. A formwork including the one-sided insulated wall form of claim 12 in combination with a coupling for coupling and de-coupling said one-sided insulated form to the removable panel.

14. The one-sided insulated wall form of claim 12 wherein said panel connecting portion is couplable to the removable panel using removable fasteners.

15. The one-sided insulated wall form of claim 13 wherein said coupling is a waler and a removable fastener.

16. The one-sided insulated wall form of claim 12, wherein said reinforcement member has an outer surface to which a finishing material can be attached.

17. The one-sided insulated wall form of claim 16, wherein said outer surface of the reinforcement member extends substantially the full height of the insulating panel.

18. The one-sided insulated wall form of claim 16, wherein said outer surface of the reinforcement member at least partially abuts the outer surface of said insulating panel.

19. The one-sided insulated wall form of claim 16, wherein said outer surface of the reinforcement member is flush with the outer surface of said insulating panel.

20. The one-sided insulated wall form of claim 16, wherein said outer surface of the reinforcement member is completely exposed on the outer surface of said insulating panel.

21. The one-sided insulated wall form of claim 12, wherein said reinforcement member and said tie member are integrally formed.

22. The one-sided insulated wall form of claim 12, wherein said tie member is releasably engageable with said reinforcement member at an inner bearing surface of said insulating panel.

23. An asymmetric tie member for connecting and maintaining first and second panels of a formwork in a fixed, spaced relationship during the wall building process, the first and second panels each having respective inner and outer panel surfaces and a top and bottom, said asymmetric tie having a first end, second end and a length defined as the distance between the first and second ends, the length corresponding, approximately, to a wall thickness described by the space between the first and second panel inner wall surfaces when the first and second panels are connected by said asymmetric tie, said asymmetric tie member comprising:

a first portion located proximate the first end, said first portion being connected to the first panel and being located adjacent to the first panel inner wall surface;

a second portion located proximate the second end, said second portion being connected to the second panel and having a height substantially less than the height of said first portion; and an intermediate portion extending between said first and second portions wherein said asymmetric tie member resists outwardly directed forces applied to the inner panel surfaces.

24. An asymmetric tie member for connecting and maintaining first and second panels of a formwork in a fixed, spaced relationship during the wall building process, the first and second panels each having respective inner and outer panel surfaces and a top and bottom, said asymmetric tie having a first end, second end and a length defined as the distance between the first and second ends, the length corresponding, approximately, to a wall thickness described by the space between the first and second panel inner wall surfaces when the first and second panels are connected by said asymmetric tie, said asymmetric tie member comprising:

a first portion located proximate the first end, said first portion being connectable to the first panel and being located adjacent to the first panel inner wall surface when said asymmetric tie member is connected to the first panel;

a second portion located proximate the second end, said second portion being connectable to the second panel and having a height substantially less than the height of said first portion; and an intermediate portion extending between said first and second portions;

wherein said first portion is releasably engageable with the first panel.

25. An asymmetric tie member for connecting and maintaining first and second panels of a formwork in a fixed, spaced relationship during the wall building process, the first and second panels each having respective inner and outer panel surfaces and a top and bottom, said asymmetric tie having a first end, second end and a length defined as the distance between the first and second ends, the length corresponding, approximately, to a wall thickness described by the space between the first and second panel inner wall surfaces when the first and second panels are connected by said asymmetric tie, said asymmetric tie member comprising:

a first portion located proximate the first end, said first portion being connectable to the first panel and being located adjacent to the first panel inner wall surface when said asymmetric tie member is connected to the first panel;

a second portion located proximate the second end, said second portion being connectable to the second panel and having a height substantially less than the height of said first portion; and an intermediate portion extending between said first and second portions;

wherein said second portion is adapted for releasable engagement with the second panel.

26. The asymmetric tie member of claim 23, wherein said intermediate portion tapers from said first portion to said second portion.

27. The asymmetric tie member of claim 23 wherein the first panel is an insulating panel and the second panel is a removable panel.

28. A method of making a wall from pourable building material, said method comprising the steps of:

providing a one-sided wall form, comprising the steps of:

providing an insulating panel having an inner and outer panel surface wherein the outer panel surface corresponds to at least a part of the outer wall surface of a wall constructed with the one-sided wall form, and providing a connecting structure including a permanent reinforcement and a tie, the permanent reinforcement being secured to the insulating panel and including a support member for distributing building loads across a region of the insulating panel, the building loads being sufficiently distributed by the support member to permit support of the insulating panel by the support member during the wall building process, and the tie extending from the inner panel surface of the insulating panel to a terminal end of the tie;

attaching a removable panel to the one-sided form to thereby define a space for receiving building material, wherein the space for receiving building material is defined by a wall thickness approximately equal to the distance from the inner panel surface to the tie terminal end, comprising the steps of;

positioning the removable panel adjacent the tie terminal end, and securing the removable panel to the tie terminal end;

pouring building material into the space; and disconnecting the removable panel from the wall.

29. The method of claim 28, wherein said step of attaching the removable panel comprises engaging a coupling with the tie terminal end and attaching the connecting structure to the removable panel by removably fastening the coupling to the removable panel.

30. The method of claim 29, wherein said step of removing the removable panel from the wall includes the step of removing the removable panel from the coupling.

31. The method of claim 29, wherein the coupling is removably fastened to the removable panel using removable fasteners.

32. The method of claim 28, wherein said step of providing a one-sided wall form comprises molding the connecting structure into the insulating panel.

33. A wall form for receiving pourable building material, comprising:

an insulating panel including a permanent reinforcement member fixed to said insulating panel, said reinforcement member including a panel support for distributing building loads across a region of said insulating panel, the building loads being sufficiently distributed by said panel support to permit support of said insulating panel by said reinforcement member during the wall building process;

a removable panel;

a connecting structure extending between said insulating and removable panels and defining a space therebetween for receiving the pourable building material; and a coupling assembly, separate from said connecting structure, for mating said removable panel to said connecting structure;

wherein when said removable panel is mated to said connecting structure, said connecting structure and said reinforcement member maintain a fixed spaced relationship between said insulating and removable panels during the wall building process.

34. The wall form of claim 33, wherein said connecting structure comprises said permanent reinforcement and a tie member securable to said reinforcement.

35. The wall form of claim 34 wherein said reinforcement and tie member are integrally formed.

36. The wall form of claim 13, wherein said coupling comprises a waler and a plurality of removable fasteners.

37. The wall form of claim 33, said insulating panel having a top, bottom and a center defined as a location approximately equidistant from the top and bottom, wherein the coupling is disposed at substantially the same level as the center of the insulating panel.

38. The wall form of claim 33, said insulating panel having a top, bottom and a center defined as a location approximately equidistant from the top and bottom, wherein the coupling is located substantially below or above the level of the center of the insulating panel.

39. The wall form of claim 33, wherein the connecting structure is substantially in the shape of an isosceles triangle.

40. The wall form of claim 33, wherein the connecting structure is substantially in the shape of a right triangle.

41. A one-sided insulated wall form for receiving pourable building material, comprising:

an insulating panel having a first thickness;

a removable panel having a second thickness, wherein said second thickness is substantially less than said first thickness;

a permanent reinforcement member fixed to said insulating panel, said reinforcement member including a panel support for distributing building loads across a region of said insulating panel, wherein the region of distributed building loads is such as to not require the application of external pressure supports to said permanent panel during the wall building process; and a connecting structure for connecting said removable panel and said insulating panel, said connecting structure being coupled to said reinforcement member and extending between said insulating panel and said removable panels, wherein said insulating panel and said removable panel are maintained in a fixed, spaced relationship prior to the pouring of the building material when said connecting structure is connected to said removable panel and wherein said removable panel is removable from said connecting structure after the pouring of the pourable building material by disconnecting said removable panel from said connecting structure.

42. The one-sided insulated wall form of claim 41, wherein said removable panel is made from a non-insulating material.

43. The asymmetric tie member of claim 26, wherein said asymmetric tie member is triangular in shape.

44. The asymmetric tie member of claim 27, wherein the removable panel is made from a non-insulating material.

45. The asymmetric tie member of claim 27, wherein a space for receiving pourable building material is defined by the distance between the inner wall surfaces of the insulating panel and the removable panel, wherein said asymmetric tie first and second portions are located between the inner wall surfaces.

46. The asymmetric tie member of claim 27, wherein the removable panel is made from an insulating material.

* * * * *